US006571941B2

(12) United States Patent
Holley, Jr.

(10) Patent No.: US 6,571,941 B2
(45) Date of Patent: Jun. 3, 2003

(54) BASKET-STYLE ARTICLE CARRIER HAVING REINFORCED HANDLE JOINTS AND CARRIER BLANK THEREFOR

(75) Inventor: John M. Holley, Jr., Lawrenceville, GA (US)

(73) Assignee: The Mead Corporation, Dayton, OH (US)

( * ) Notice: Subject to any disclaimer, the term of this patent is extended or adjusted under 35 U.S.C. 154(b) by 103 days.

(21) Appl. No.: 09/794,690

(22) Filed: Feb. 27, 2001

(65) Prior Publication Data

US 2002/0117407 A1 Aug. 29, 2002

(51) Int. Cl.[7] ..... B65D 75/00

(52) U.S. Cl. ..... 206/162; 206/175; 206/196; 206/434

(58) Field of Search ..... 206/139, 141, 206/142, 143, 144, 167, 169, 170, 171, 174, 175, 193, 194, 196, 427, 434

(56) References Cited

U.S. PATENT DOCUMENTS

| | | | | |
|---|---|---|---|---|
| 2,772,020 A | | 11/1956 | Kramer | |
| 3,011,677 A | | 12/1961 | Struble | |
| 5,538,131 A | * | 7/1996 | Harrelson | 206/162 |
| 5,645,162 A | | 7/1997 | Harrelson | |
| 6,168,013 B1 | | 1/2001 | Gomes | |
| 6,341,689 B1 | * | 1/2002 | Jones | 206/175 |

FOREIGN PATENT DOCUMENTS

| | | |
|---|---|---|
| GB | 926874 | 5/1963 |
| WO | 96/26132 | 8/1996 |
| WO | 98/16441 | 4/1998 |
| WO | 98/28200 | 7/1998 |
| WO | 00/51893 | 9/2000 |

* cited by examiner

*Primary Examiner*—Shian Luong

(57) ABSTRACT

A basket-style carrier is formed from a single blank and includes parallel first and second side walls, parallel first and second end walls, and a composite handle structure arranged between the first and second side walls. The handle structure has first and second handle panels secured together in a juxtaposed relationship. A first securing member is hingedly connected to the first handle panel and glued to the inside surface of the first end wall to create a joint between the handle structure and the first end wall. A first joint-reinforcing member is hingedly connected to the second handle panel and glued to the inside surface of said first end wall.

25 Claims, 5 Drawing Sheets

BASKET-STYLE ARTICLE CARRIER HAVING REINFORCED HANDLE JOINTS AND CARRIER BLANK THEREFOR

BACKGROUND OF THE INVENTION

The present invention relates generally to paperboard carriers for use in packaging articles such as beverage bottles, and more particularly to a basket-style carrier formed from a single blank and has a carrier handle connected to a carrier end wall through a reinforced joint. The invention is particularly useful to provide a basket-style carrier having a seamless end wall while using minimum amount of paperboard.

Basket-style paperboard carriers made from a single blank are well known. These carriers are formed from blanks that are cut and scored from paperboard or other foldable sheet material. It is common that the blanks for making basket-style carriers have an irregular shape, such as having a large protuberance extending off to one side. For example, some carrier blanks for basket-style carriers are generally L-shaped. Some carrier blanks include large open spaces. Such an irregular shape results in a considerable amount of waste paperboard, which leads to substantial inefficiency and unnecessarily high costs in the manufacture of such a blank and a basket-style carrier assembled therefrom. One of the solutions of this problem is to provide blanks having the outline that is similar to a rectangle. An example of such an approach can be seen in U.S. Pat. No. 3,011,677. The carrier blank of this patent has rows of component panels arranged side by side. The panels are so arranged that the carrier in an erected form has a handle connected to each end wall by a single glue tab. This is of disadvantage because the glue tab provides a joint that is not as strong as desirable.

Accordingly, it can be seen that a need yet remains for a basket-style carrier and a blank therefore which minimize the amount of paperboard necessary to make such a carrier or blank and still provide a strong joint between the carrier handle and each end wall. It is to the provision of such a carrier and a blank therefore that the present invention is primarily directed.

SUMMARY OF THE INVENTION

In meeting the foregoing needs, the present invention provides a basket-style carrier formed from a single blank. The carrier comprises substantially parallel first and second side walls, substantially parallel first and second end walls interconnecting the side walls, and a composite handle structure disposed between the first and second side walls and extending between the first and second end walls. The handle structure includes first and second handle panels secured together in a juxtaposed relationship. A first securing member is hingedly connected to the first handle panel and is adhesively secured to the inside surface of the first end wall to create a joint between the handle structure and the first end wall. Further, a first joint-reinforcing member is hingedly connected to the second handle panel, and it is adhesively secured to the inside surface of the first end wall. According to the invention, the handle structure is connected to the first end wall not only by the securing member but also by the joint-reinforcing member which strengthen the joint created by the securing member.

In a preferred embodiment, a first transverse partition member may be hingedly connected to both the first handle panel and the first side wall while a second transverse partition member is hingedly connected to the second handle panel and the second side wall. The first partition member provides a transverse partition extending between the handle structure and the first side wall while the second partition member provides a transverse partition extending between the handle structure and the second side wall.

In another preferred embodiment, a third handle panel may be secured to the first and second handle panels in a juxtaposed relationship to create the handle structure. A second securing member may be hingedly connected to the second handle panel and adhesively secured to the inside surface of the second end wall to create a joint between the handle structure and the second end wall. A second joint-reinforcing member may be hingedly connected to the third handle panel and adhesively secured to the inside surface of the second end wall. In this embodiment, at least one of the first and second end walls may be symmetrical in shape. Alternatively or at the same time, the second end wall may be a seamless panel. The second handle panel may be hingedly connected at its one end to the second securing member and at its other end to the first joint-reinforcing member. Optionally, the first joint-reinforcing member may hingedly connect between the second handle panel and the second side wall, and the second securing member may hingedly connect between the second handle panel and the second end wall. The third handle panel may be hingedly connected at its one end to the first handle panel and at its other end to the second joint-reinforcing member.

The present invention also provides a carrier blank for making a basket style carrier. The blank comprises an elongate medial section having formed therein first and second side wall panels and first and second end wall panels, a first exterior section formed alongside the medial section and having formed therein a plurality of handle panels. The handle panels are adapted to form a composite carrier handle structure in an erected form of the blank. The handle panels comprise a first handle panel and a second handle panel that is arranged at one end of the first exterior section. A first securing member hingedly interconnects the first handle panel and the first end wall panel. In an erected form of the blank, the first securing member may be secured to the first end wall panel to create a joint between the handle structure and the first end wall panel. A first joint-reinforcing member is hingedly connected to the second handle panel and arranged next to one end of the medial section. The first joint-reinforcing member may be secured to the first end wall panel to reinforce the joint when the blank is erected into a carrier. This blank provides an erected carrier wherein the composite handle structure is connected to the first end wall panel through a strengthened joint that is provided by the securing member and the joint-reinforcing member.

In a preferred embodiment, the first joint-reinforcing member may be disposed transversely of the axis of elongation of the medial section and spans at least in part the medial section.

In another preferred embodiment, the first end wall panel, the first side wall panel, the second end wall panel and the second side wall panel may be arranged in the described sequence. In this embodiment, a first transverse partition member may hingedly interconnect the first handle panel and the first side wall panel while a second transverse partition member hingedly interconnects the second handle panel and the second side wall panel.

In another preferred embodiment, the plurality of handle panels may further comprise a third handle panel arranged at the other end of the first exterior section. A second joint-reinforcing member may be hingedly connected to the third handle panel and arranged next to the other end of the medial section so that when the blank is erected into a finished carrier, the second joint-reinforcing member may be secured to the second end wall panel. Optionally, a second securing member may hingedly interconnect the second handle panel and the second end wall panel. The second securing member is adapted to be secured to the second end wall panel to create a joint between the handle structure and the second end wall panel when the blank is erected into a carrier. It is preferred that the second joint-reinforcing member is disposed transversely of the axis of elongation of the medial section and spans at least in part the medial section.

In a further preferred embodiment, a second securing member may hingedly interconnect the second handle panel and the second end wall panel. The second securing member may be secured to the second end wall panel to create a joint between the handle structure and the second end wall panel when the blank is erected into a finished carrier. The second handle panel may be hingedly connected at one end thereof to the second securing member and at the other end thereof to the first joint-reinforcing member.

In a still further preferred embodiment, the second side wall panel may be arranged at the one end of the medial section, and the first joint-reinforcing member may also be hingedly connected to the second side wall panel.

In a still further preferred embodiment, the first end wall panel may be arranged at the other ends of the medial section, and the third handle panel may be arranged at a location flanking the first end wall panel. Alternatively or at the same time, the third handle panel may be hingedly connected at one end thereof to the first handle panel and at the other end thereof to the second joint-reinforcing member.

In a still further preferred embodiment, a second exterior section may be formed alongside the medial section and positioned opposite the first exterior section. The second exterior section may include first and second bottom panels formed therein. The first and second bottom panels may be hingedly connected to the first and second side panels respectively.

DETAILED DESCRIPTION OF THE PREFERRED EMBODIMENT

Figure 1:
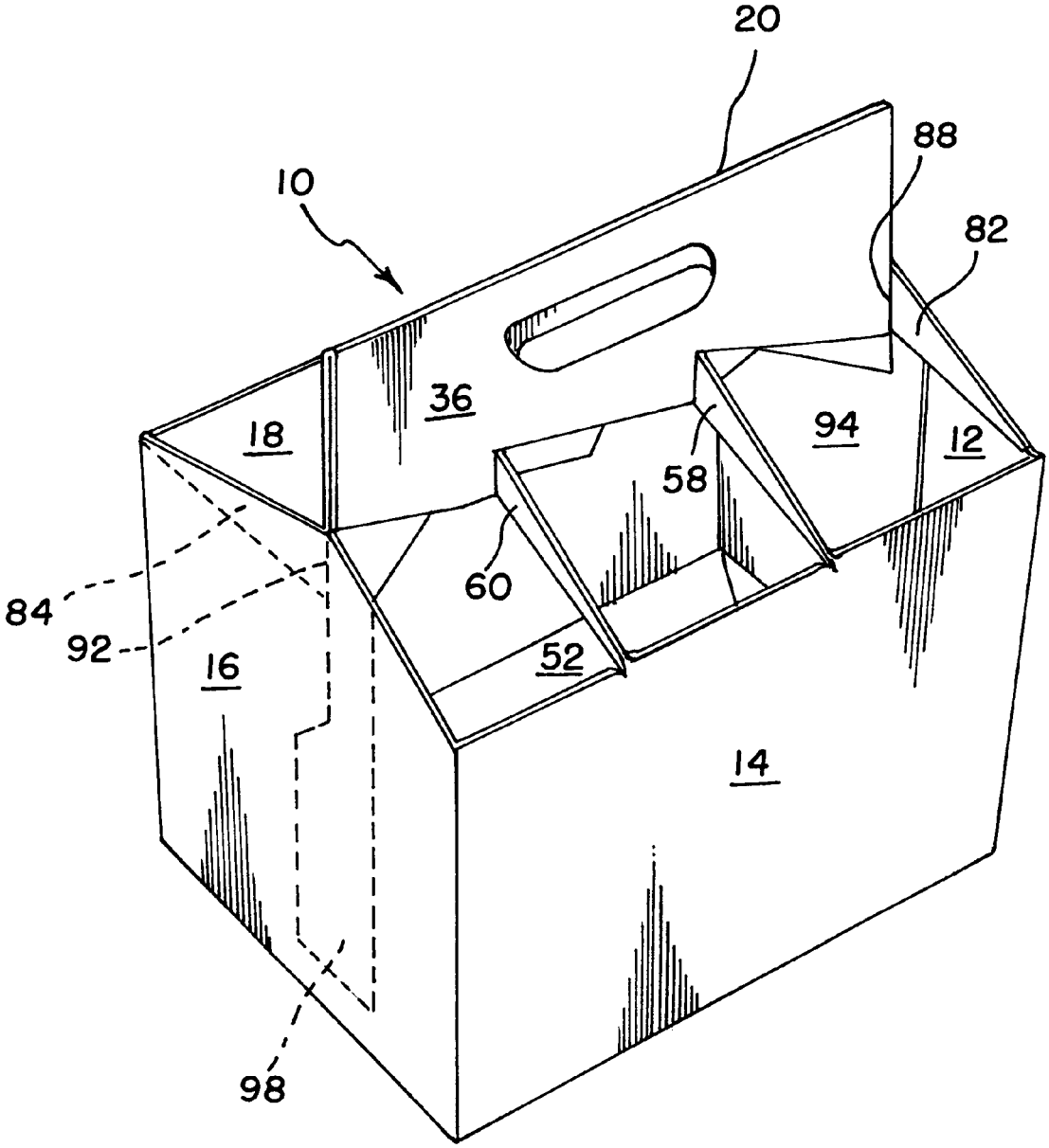
FIG. 1 is a perspective view of a basket-style carrier in accordance with a preferred embodiment of the invention, showing the handle structures connected to the first end wall by both the securing member and the joint-reinforcing member.

Throughout the drawings, the same reference numerals are used to denote the same features. Referring to FIG. 1, the present invention provides a basket-style article carrier 10 for carrying articles such as beverage bottles. The carrier 10 is preferably formed from paperboard. However, it may be formed from any other foldable sheet material such as corrugated board, a plastic sheet or the like. The carrier has a pair of first and second side walls 14 and 18 that are arranged in a substantially parallel relationship. A pair of substantially parallel first and second end walls 12 and 16 interconnect the side walls 14 and 18 to form a vertical tubular structure. A composite handle structure 20 is located generally at the top end of the tubular structure to span the end between the first and second end walls 12 and 16. The handle structure 20 is arranged parallel to the side walls 14 and 18 at a location equidistant from the side walls 14 and 18. The longitudinal axis of the handle structure 20 lie perpendicular to the end walls 12 and 16 while the handle structure 20 is connected at its opposite ends to the end walls 12 and 16 through strengthened joints that will be described later in details.

Figure 2:
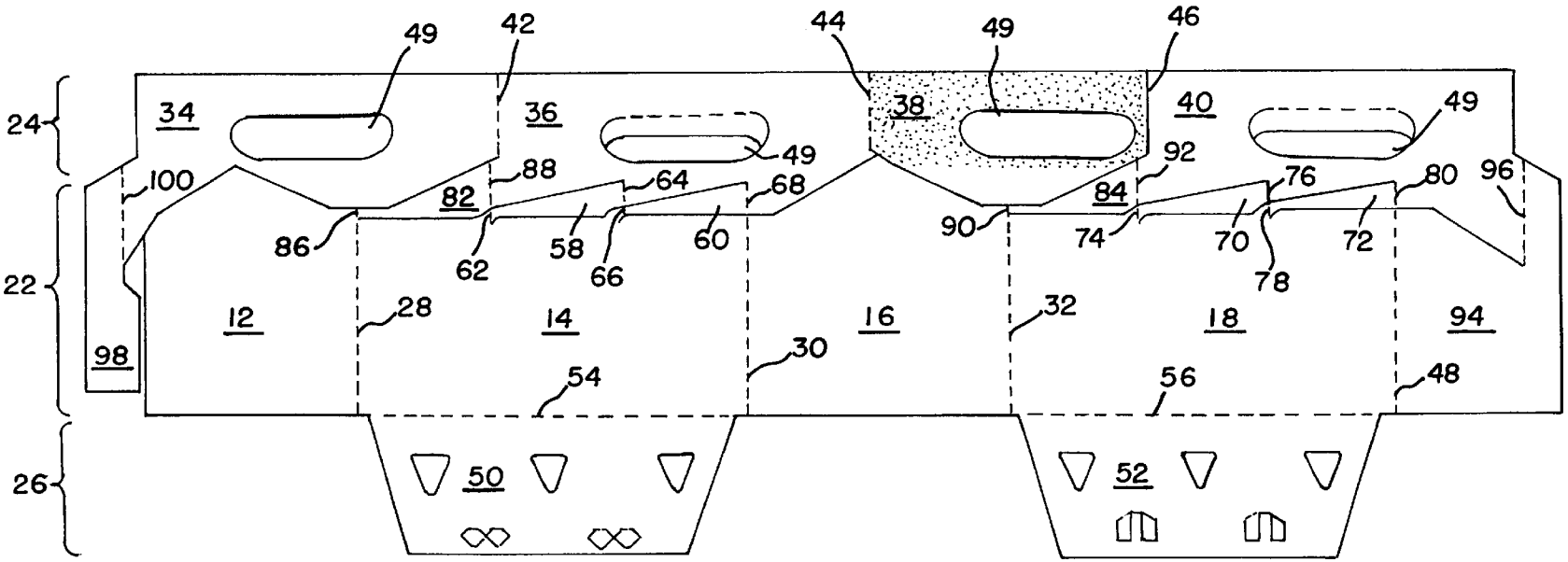
FIG. 2 is a plan view of a blank from which the carrier of FIG. 1 may be formed.

FIG. 2 illustrates a blank from which the carrier 10 is formed. The blank comprises an elongate medial section 22, an elongate upper exterior section 24 and a lower exterior section 26. These sections 22, 24 and 26 are arranged side by side to form the blank with an outline suitable to yield a minimum amount of waste paperboard. The upper exterior section 24 lies alongside the upper longitudinal edge of the medial section 22 and the lower exterior section 26 flanks the lower longitudinal edge of the medial section 22. The medial section 22 includes in the described sequence a first end wall panel 12, a first side wall panel 14, a second end wall panel 16, and a second side wall panel 18. These panels 12, 14, 16 and 18 are hingedly connected together one to the next along fold lines 28, 30 and 32 respectively to form, when the blank is erected, the aforementioned tubular structure. The fold lines 28, 30 and 32 lie parallel to one another and extend generally perpendicularly to the axis of elongation of the medial section.

The upper exterior section 24 comprises in the described sequence a third handle panel 34, a first handle panel 36, a fourth handle panel 38 and a second handle panel 40. The first, third and fourth handle panels 36, 34 and 38 are hingedly connected together one to the next along fold lines 42 and 44 respectively while the second handle panel 40 is separated from the fourth handle panel 38 by a cut line 46. The fold lines 42 and 44 are disposed perpendicularly to the axis of elongation of the medial section 22. However, the fold line 44 may be arranged at any angle with respect to the axis of elongation depending on the shape of the fourth handle panel 38.

The third handle panel 34 has the same length as the side wall panels 14 and 18 and extends from above the first end wall 12 over a part of the first side wall 14. The first handle panel 36 also has the same length as the side wall panels 14 and 18. The first panel 36 extends from the fold line 42 at an end of the third handle panel 34 along the first side wall panel 14 over a half of the second end wall panel 16. The fourth handle panel 38 is a partial panel and is shorter than the side wall panels 14 and 18. The fourth handle panel 38 extends from the fold line 44 at an end of the first handle panel 36 above the other half of the second end wall panel 16 and also extends over a part of the second side wall panel 18. The second handle panel 40 is also a full length panel having the same length as the side wall panels 14 and 18. The second handle panel 40 extends from the cut line 46 at an end of the fourth panel 38 along the second side wall panel 18 and also extends outwardly beyond the fold line 48 at an end of the medial section 22. Each of the handle panels 34, 36, 38 and 40 is formed with a slot 49. These slots 49 are positioned so that they are registered one with another to form a hand aperture when the handle panels are secured together to form the handle structure 20.

The lower exterior section 26 comprises first and second bottom lap panels 50 and 52 that are hingedly connected to the first and second side wall panels 14 and 18 along fold lines 54 and 56 respectively. These bottom panels 50 and 52 are sized, tapered, and spaced from each other to create open spaces adjacent these panels 50 and 52 so that bottom panels of an another like carrier blank are allowed to be nestably received in the open spaces when the blanks are cut from a web of paperboard. This arrangement minimizes the amount of paperboard scrap. The bottom panels 50 and 52 are sized to overlap each other in an erected carrier and are provided with known locking means, such as a tab-and-aperture lock, for securing themselves together.

The medial section 22 and the upper exterior section 24 are interconnected by several different elements. These elements include a pair of first partition straps 58 and 60, a pair of second partition straps 70 and 72, and a pair of first and second securing straps 82 and 84.

The first partition straps 58 and 60 are formed from the blank between the first handle panel 36 and the first side wall panel 14. The partition strap 58 is hingedly connected to the first side wall panel 14 along a fold line 62 and to the first handle panel 36 along a fold line 64. Otherwise, the partition strap 58 is severed from the blank. Similarly, the partition strap 60 is severed from the blank except at the hinged connections along fold lines 66 and 68 to the first side wall panel 14 and the first handle panel 36, respectively. The fold lines 64 and 66 are aligned with each other while the fold lines 68 and 30 are aligned with each other. The fold lines 62, 64, 66 and 68 of the first partition straps 58 and 60 lie perpendicularly to the axis of elongation of the medial section 22.

In like manner, the second partition straps 70 and 72 are formed from the blank between the second handle panel 40 and the second side wall panel 18. The partition strap 70 is hingedly connected to the second side wall panel 18 along a fold line 74 and to the second handle panel 40 along a fold line 76. The other part of the partition strap 70 is severed from of the blank. Similarly, the partition strap 72 is severed from the blank except at the hinged connections along fold lines 78 and 80 to the second side wall panel 18 and the second handle panel 40, respectively. The fold lines 76 and 78 are aligned with each other while the fold lines 80 and 48 are aligned with each other. The fold lines 74, 76, 78 and 80 of the second partition straps 70 and 72 lie perpendicularly to the axis of elongation of the medial section 22.

The first securing strap 82 is formed from the blank between the third handle panel 34 and the first side wall panel 14. The first securing strap 82 is hingedly connected to the first end wall panel 12 along a fold line 86 and to the first handle panel 36 along a fold line 88. Otherwise, the first securing strap 82 is severed from the blank. The fold line 86 of the first securing strap 82 is aligned with the fold line 28. The second securing strap 84 is formed from the blank between the fourth handle panel 38 and the second side wall panel 18. The securing strap 84 is hingedly connected to the second end wall panel 16 along a fold line 90 and to the second handle panel 40 along a fold line 92. The other part of the second securing strap 84 is severed from the blank. The fold line 90 of the second securing strap 84 is aligned with the fold line 32. The fold lines 86, 88, 90 and 92 of the securing straps 82 and 84 lie also perpendicularly to the axis of elongation of the medial section 22.

The respective right-hand ends, as viewed in FIG. 2, of the medial and upper exterior sections 22 and 24 are interconnected by a joint-reinforcing panel 94. A part of the reinforcing panel 94 is located under the portion of the second handle panel 40 that extends beyond the end 48 of the medial section 22. The panel 94 is of a size that spans the medial section 22 and hingedly connected to the second side wall panel 18 along the fold line 48. The other part of the panel 94 extends upwardly and hingedly connected to the second handle panel 40 along a fold line 96. The panel 94, otherwise, is disconnected from the blank. The fold lines 48 and 96 are disposed parallel at a space and extend perpendicularly to the axis of elongation of the medial section 22.

Further, a joint-reinforcing flap 98 is provided next to the left-hand ends, as viewed in FIG. 2, of the medial and upper exterior sections 22 and 24. The reinforcing flap 98 is hingedly connected to the third handle panel 34 along a fold line 100. Otherwise, it is separated from the blank. The size of the reinforcing flap 98 is such that it extends downwardly from the upper exterior section 24 and partially spans the medial section 22. The fold line 100 lies perpendicularly to the axis of elongation of the medial section 22.

Figure 3:
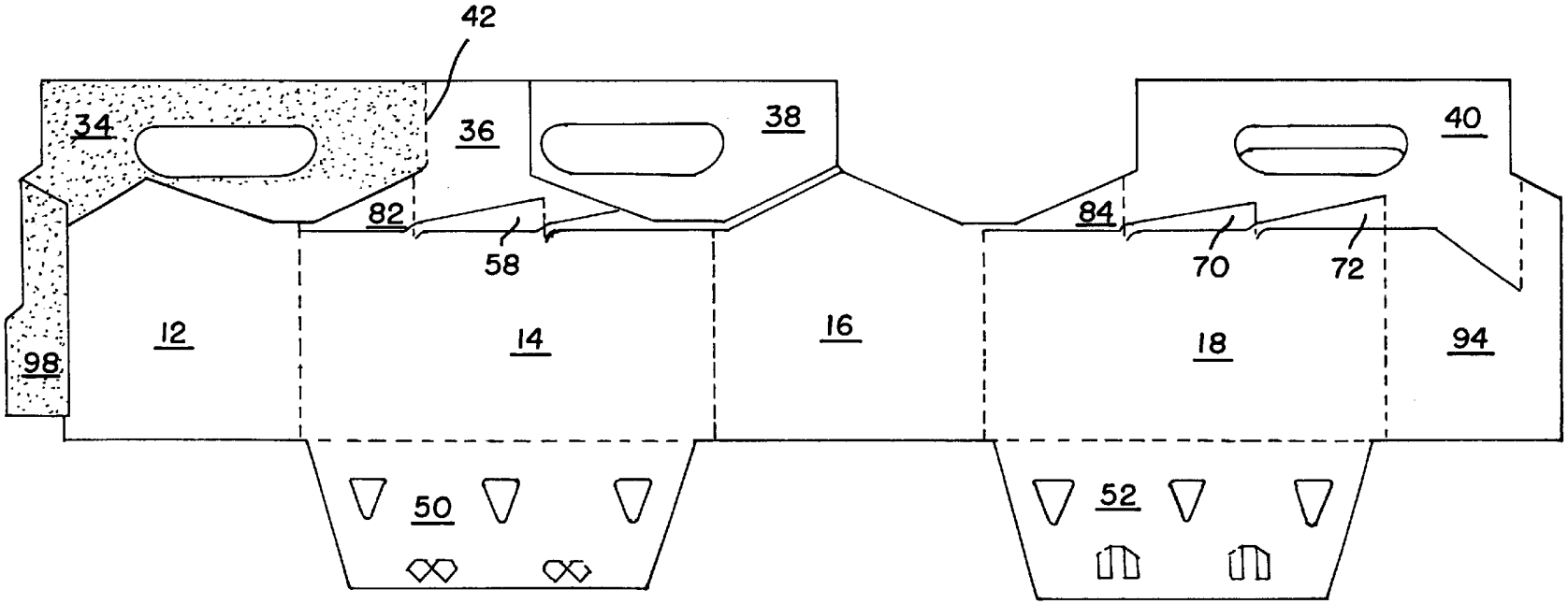
FIGS. 3–6 are series of plan views showing the manner in which the blank of FIG. 2 may be folded to form the completed collapsed carrier.

To erect the carrier 10 of FIG. 1 from the blank of FIG. 2, the fourth handle panel 38 is applied with glue as indicated by stippling in FIG. 2 and is folded about the fold line 44 to take the position depicted in FIG. 3. This causes the fourth handle panel 38 to be secured to the first handle panel 36 in a face-to-face contacting relationship. Meanwhile, or at the same time as the folding of the fourth handle panel 38, the joint-reinforcing flap 98 is folded about the fold line 100 to take a position shown also in FIG. 3. Glue is then applied to the third handle panel 34 as well as to the reinforcing flap 98 as indicated by stippling in FIG. 3, and the panel 34 and the flap 98 are swung 180 degrees about the fold line 42 to the position shown in FIG. 4. As a result, the third handle panel 34 is secured to the first and fourth handle panels 36 and 38 while the reinforcing flap 98 is adhered to the inside surface of the second end wall panel 16.

Figure 4:
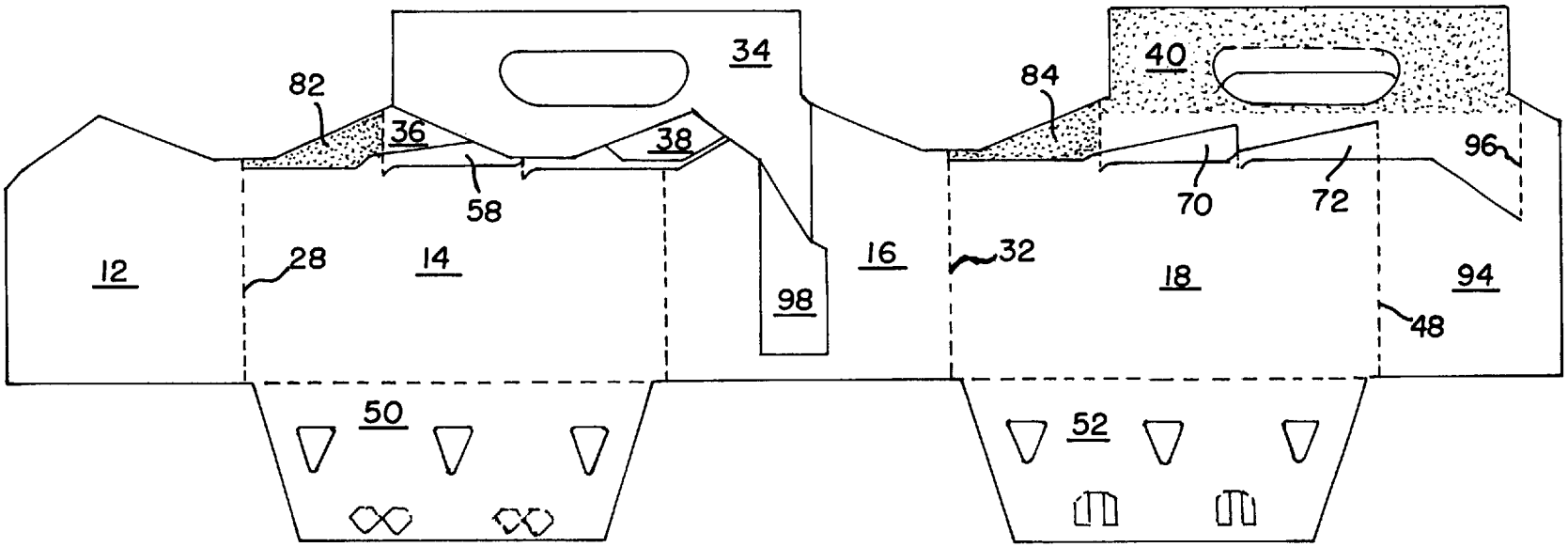
Figure 5:
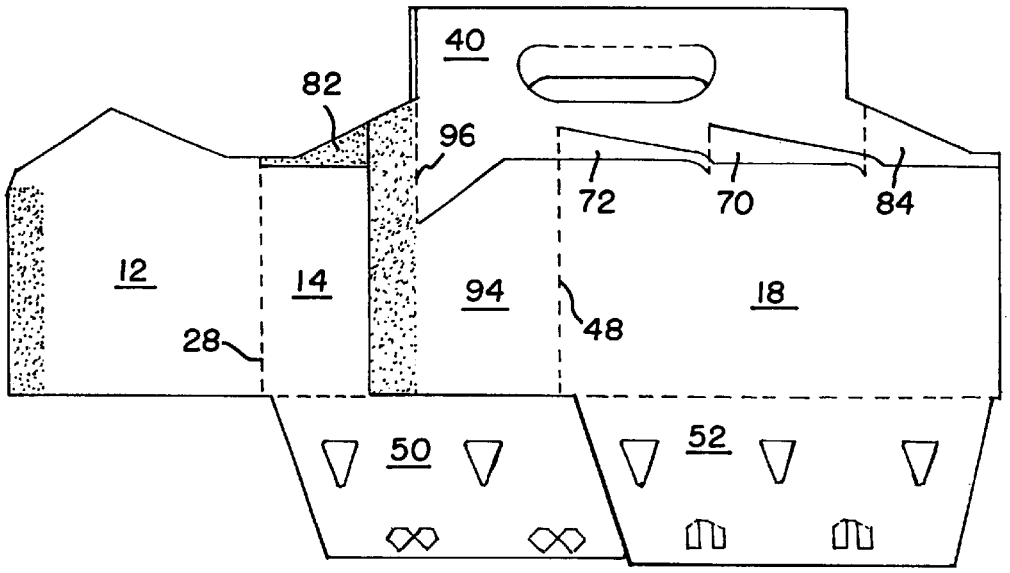

The next step for the assembling is the application of glue to the securing straps 82 and 84 and to the second handle panel 40. After the glue application, the parts of the blank on the right-hand side of the fold line 32 as viewed in FIG. 4 is folded as a unit toward the left about the fold line 32 to take the position illustrated in FIG. 5. At this step, the second securing strap 84 is affixed to the inside surface of the second end wall panel 16, and the second handle panel 40 is secured to the third handle panel 34 to complete the handle structure 20 of a four-ply composite construction. Also at the same step, a part of the first securing strap 82 is adhered to the inside surface of the reinforcing panel 94. Subsequently, application of glue is made to the respective portions of the first end wall panel 12 and the reinforcing panel 94 as illustrated by the stippling in FIG. 5, and then the first end wall panel 12 is folded about the fold line 28 to overlie the reinforcing panel 94. This causes the panel 94 to be affixed to the inside surface of the first end wall panel 12.

Figure 6:
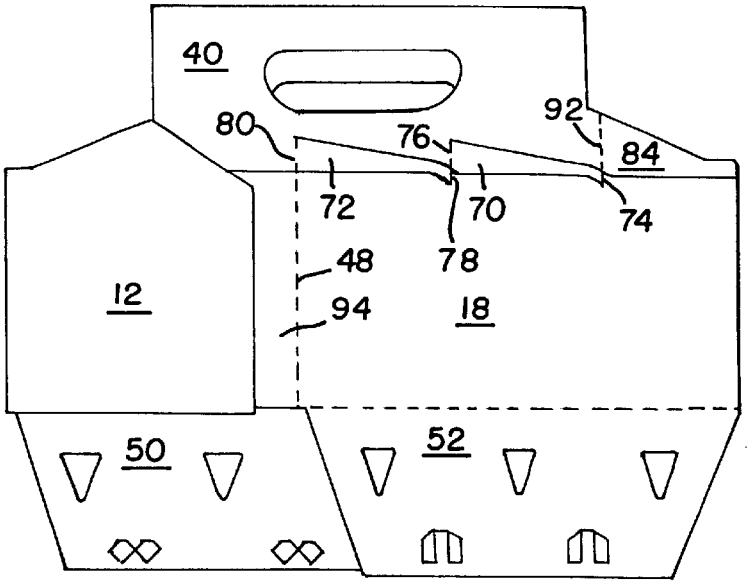

The carrier thus formed is shown in FIG. 6 wherein the carrier is in a flat collapsed condition and may be shipped to the bottling plant in this condition. At the bottling plant, the carrier is opened so that the side and end wall panels 12, 14, 16 and 18 create the tubular structure and thereby the handle structure 20 becomes spaced from and parallel to the side wall panels 14 and 18. By so opening the flat carrier, the first and second end wall panels 12 and 16 turn about the fold lines 88 and 92 respectively and take the positions generally perpendicular to the longitudinal axis of the handle structure 20 as shown in FIG. 1. The opening of the flat carrier also causes the first and second partition straps 58, 60, 70 and 72 to fold about their fold lines 62, 64, 66, 68, 74, 76, 78 and 80 and to take the respective positions where each partition strap extends transversely of the handle structure 20. As shown in FIG. 1, the first transverse partition straps 58 and 60 extend between the first handle panel 36 and the first side wall panel 14. Although not illustrated in FIG. 1, the second transverse partition straps 70 and 78 extend between the second handle panel 40 and the second side wall panel 18.

The bottom of the carrier may be closed before or after the carrier is loaded with articles. To close the bottom of the carrier, the bottom panel 52 is folded upwardly about the fold line 56 to take a horizontal position generally perpendicular to the side and end wall panels 12, 14, 16 and 18. The bottom panel 50 is then folded upwardly about the fold line 54 to partially underlie the bottom panel 52. The overlapping areas of the bottom panels 50 and 52 are secured together by known locking means as mentioned earlier. Alternatively, the bottom panels 50 and 52 may be adhesively secured to each other. Articles may be drop-loaded into the carrier thereafter. Otherwise, articles may be loaded before the bottom is closed. To do so, the carrier is applied to a group of articles from above the articles.

Referring again to FIG. 1, the carrier in an erected form has a seamless, symmetrical end wall 16 opposed to a seamed symmetrical end wall that is made up of the end wall panel 12 and the reinforcing panel 94. The end wall 16 is connected to an end of the handle structure 20 by a joint created by the securing strap 84 that has been glued to the inside surface of the end wall 16. The end wall 12 is connected to the other end of the handle structure 20 through a joint created by the securing strap 82 that has been glued to the inside surface of the end wall 12. These joints are reinforced by the joint-reinforcing members 98 and 94. That is to say, the end wall 16 is further connected to the one end of the handle structure 20 by the reinforcing flap 98 that is glued to the inside surface of the end wall 16, and the end wall 12 is further connected to the other end of the handle structure 20 by the reinforcing panel 94 that is glued to the inside surface of the end wall 12. These joint-reinforcing members 94 and 98, as described earlier, have been taken from the areas adjacent to the opposite ends of the blank and thus do not substantially change the elongated outline of the blank that is suitable to yield a minimum amount of waste paperboard. Nonetheless, the joint-reinforcing members 94 and 98 considerably strengthen the joints at the opposite ends of the handle structure to provide a sturdier carrier that can bear the load of relatively heavy articles such as glass-bottled beverage.

It would be recognized that variations may be made to the foregoing embodiment within the scope of the invention. For example, the reinforcing panel 94 may be divided into two separate members, i.e., a joint-reinforcing flap connected to the second handle panel 40 and a glue flap joined to the second side wall panel 18 to be secured to the end wall panel 12.

What is claimed is:

1. A basket-style carrier formed from a single blank to receive a plurality of articles, comprising:

substantially parallel first and second side walls;

substantially parallel first and second end walls interconnecting said side walls;

a composite handle structure disposed between said first and second side walls and extending between said first and second end walls, said handle structure comprising first and second handle panels secured together in a juxtaposed relationship;

a first securing member hingedly connected to said first handle panel and adhesively secured to an inside surface of said first end wall to create a joint between said handle structure and said first end wall; and a first joint-reinforcing member hingedly connected to said second handle panel and adhesively secured to said inside surface of said first end wall, wherein said first and second side and end walls, said handle structure, said first securing member and said first joint-reinforcing member are formed from a single blank.

2. The carrier according to claim 1 further comprising first and second transverse partition members formed from said single blank, said first transverse partition member extending between and being hingedly connected to said first handle panel and said first side wall, said second transverse partition member extending between and being hingedly connected to said second handle panel and said second side wall.

3. The carrier according to claim 1 further comprising a second securing member and a second joint-reinforcing member formed from said single blank, wherein said handle structure further comprises a third handle panel secured to said first and second handle panels in a juxtaposed relationship, wherein said second securing member is hingedly connected to said second handle panel and adhesively secured to an inside surface of said second end wall to create a joint between said handle structure and said second end wall, and wherein said second joint-reinforcing member is hingedly connected to said third handle panel and adhesively secured to said inside surface of said second end wall.

4. The carrier according to claim 3 wherein at least one of said first and second end walls is symmetrical in shape.

5. The carrier according to claim 3 wherein said second end wall is a seamless panel.

6. The carrier according to claim 3 wherein said handle structure has a longitudinal axis disposed perpendicular to the first and second end walls, said second handle panel extends along said longitudinal axis, and said second handle panel is hingedly connected at one end thereof to said second securing member and at the other end thereof to said first joint-reinforcing member.

7. The carrier according to claim 6 wherein said first joint-reinforcing member hingedly connects between said second handle panel and said second side wall, and said second securing member hingedly connects between said second handle panel and said second end wall.

8. The carrier according to claim 3 wherein said handle structure has a longitudinal axis disposed perpendicular to said first and second end walls, said third handle panel extends along said longitudinal axis, and said third handle panel is hingedly connected at one end thereof to said first handle panel and at the other end thereof to said second joint-reinforcing member.

9. The carrier according to claim 8 wherein said first securing member extends generally perpendicularly to said longitudinal axis, said first securing member is hingedly connected at one end thereof to said first handle panel and at the other end thereof to said first end wall.

10. The carton according to claim 9 wherein said one end of said third handle panel is connected to said first handle panel along a handle panel fold line, said one end of said first securing member is connected to said first handle panel along a securing member fold line, said handle panel fold line and said securing member fold line are offset from each other, and said securing member fold line is disposed below said handle panel fold line.

11. A carrier blank for making a basket-style carrier for receiving a plurality of articles, said carrier blank comprising:

an elongate medial section having an axis of elongation and having formed therein first and second side wall panels and first and second end wall panels;

a first exterior section formed alongside said medial section and having formed therein a plurality of handle panels for, when said blank is erected into a finished carrier, forming a composite handle structure by which said carrier is lifted, said plurality of handle panels comprise first and second handle panels, said second handle panel being arranged at one end of said first exterior section;

a first securing member hingedly connecting between said first handle panel and said first end wall panel so that when said blank is erected into a finished carrier, said first securing member may be secured to said first end wall panel to create a joint between said handle structure and said first end wall panel; and a first joint-reinforcing member hingedly connected to said second handle panel and arranged next to one end of said medial section so that when said blank is erected into a finished carrier, said first joint-reinforcing member may be secured to said first end wall panel to reinforce said joint.

12. The blank according to claim 11 wherein said first joint-reinforcing member is disposed transversely of said axis of elongation and spans at least in part said medial section.

13. The blank according to claim 11 wherein said first and second end wall panels and said first and second side wall panels are arranged in the sequence of said first end wall panel, said first side wall panel, said second end wall panel and said second side wall panel.

14. The blank according to claim 13 further comprising a first transverse partition member hingedly interconnecting said first handle panel and said first side wall panel, and a second transverse partition member hingedly interconnecting said second handle panel and said second side wall panel.

15. The blank according to claim 13 wherein said second end wall panel is symmetrical in shape.

16. The blank according to claim 11 wherein said plurality of handle panels further comprise a third handle panel arranged at the other end of said first exterior section, wherein a second joint-reinforcing member is hingedly connected to said third handle panel and arranged next to the other end of said medial section so that when said blank is erected into a finished carrier, said second joint-reinforcing member may be secured to said second end wall panel.

17. The blank according to claim 16 further comprising a second securing member hingedly interconnecting said second handle panel and said second end wall panel so that when said blank is erected into a finished carrier, said second securing member may be secured to said second end wall panel to create a joint between said handle structure and said second end wall panel.

18. The blank according to claim 16 wherein said second joint-reinforcing member is disposed transversely of said axis of elongation and spans at least in part said medial section.

19. The blank according to claim 16 wherein said first end wall panel is arranged at said other ends of said medial section, and wherein said third handle panel is arranged at a location flanking said first end wall panel.

20. The blank according to claim 16 wherein said third handle panel extends along said axis of elongation and is hingedly connected at one end thereof to said first handle panel and at the other end thereof to said second joint-reinforcing member.

21. The blank according to claim 11 further comprising a second securing member hingedly interconnecting said second handle panel and said second end wall panel so that when said blank is erected into a finished carrier, said second securing member may be secured to said second end wall panel to create a joint between said handle structure and said second end wall panel, and wherein said second handle panel extends along said axis of elongation and is hingedly connected at one end thereof to said second securing member and at the other end thereof to said first joint-reinforcing member.

22. The blank according to claim 11 wherein said second side wall panel is arranged at said one end of said medial section, and wherein said first joint-reinforcing member is hingedly connected to said second side wall panel.

23. The blank according to claim 11 further comprising a second exterior section formed alongside said medial section and positioned opposite said first exterior section, said first and second exterior sections flanking said medial section, said second exterior section having first and second bottom panels formed therein, said first and second bottom panels being hingedly connected to said first and second side panels respectively.

24. The blank according to claim 11 wherein said plurality of handle panels are hingedly connected to one another along fold lines which are transverse to said axis of elongation.

25. The blank according to claim 11 wherein said plurality of handle panels are arranged one after another in the direction of said axis of elongation.

* * * * *